United States Patent [19]

Bertiller et al.

[11] Patent Number: 4,872,390

[45] Date of Patent: Oct. 10, 1989

[54] INSERT BARREL WITH ADJUSTING DEVICE

[75] Inventors: Roland Bertiller, Schramberg; Roland Maier, Dunningen; Harald Weisser, Oberndorf-Beffendorf, all of Fed. Rep. of Germany

[73] Assignee: Mauser-Werke Oberndorf GmbH, Fed. Rep. of Germany

[21] Appl. No.: 241,021

[22] Filed: Sep. 2, 1988

[30] Foreign Application Priority Data

Sep. 3, 1987 [DE] Fed. Rep. of Germany ..... 3729412

[51] Int. Cl.[4] ..... F41F 17/06

[52] U.S. Cl. ..... 89/29

[58] Field of Search ..... 89/29, 31, 14.05; 42/76.01, 77

[56] References Cited

U.S. PATENT DOCUMENTS

| | | | |
|---|---|---|---|
| 213,616 | 3/1879 | Bowles | 42/77 |
| 2,482,808 | 9/1949 | Summerbell | 42/77 |
| 2,550,300 | 12/1970 | Roder | 42/76.01 |
| 2,949,825 | 8/1960 | Musser et al. | 89/41.16 |
| 3,353,291 | 11/1967 | Musser et al. | 42/100 |
| 4,685,235 | 8/1987 | Bunning et al. | 42/77 |

FOREIGN PATENT DOCUMENTS

| | | | |
|---|---|---|---|
| 160090 | 12/1954 | Australia | 42/76.01 |
| 190836 | 7/1957 | Austria | 42/76.01 |
| 52269 | 1/1890 | Fed. Rep. of Germany | 89/29 |
| 436868 | 11/1926 | Fed. Rep. of Germany . | |
| 2011001 | 9/1971 | Fed. Rep. of Germany | 42/77 |
| 3414193 | 10/1985 | Fed. Rep. of Germany | 42/77 |
| 7054 | 5/1886 | United Kingdom | 89/29 |
| 21354 | 10/1905 | United Kingdom | 89/29 |
| 8286 | 3/1906 | United Kingdom | 89/29 |
| 767487 | 2/1957 | United Kingdom | 89/29 |
| 2142125 | 6/1983 | United Kingdom . | |

*Primary Examiner*—Deborah L. Kyle
*Assistant Examiner*—Stephen Johnson
*Attorney, Agent, or Firm*—McGlew & Tuttle

[57] ABSTRACT

A front insert barrel bearing is adjustable by means of an adjusting device having two eccentric bushing arranged one within the other, of a front insert barrel bearing, the bushings are rotatable relative to each other, to change the position in which they support the insert gun barrel whereby a desired aiming direction of the insert barrel is made possible and a common mean point of impact with the barrel of the combat tank is achieved.

5 Claims, 4 Drawing Sheets

25
26
27
28
29
30
31
32
33
34
35
36
37
38
39
40
41
42
43
44
45
46
V
VI
VII

Fig. 8

Deviation ( Line ) — Left / Right

Deviation ( Line ) — High / Low

| 49 | 1,0 | 0,75 | 0,5 | 0,25 | 0,0 | 0,25 | 0,5 | 0,75 | 1,0 | 48 / 14,25 Eccentric bushing |
|---|---|---|---|---|---|---|---|---|---|---|
| 1,0 | | | | | 180 | | | | | inside |
| | | | | | 90 | | | | | outside |
| 0,75 | | | | 256 | | | 231 | | | inside |
| | | | | 71 | | | 31 | | | outside |
| 0,5 | | | 270 | | 300 | 292 | 270 | | | inside |
| | | | 90 | | 30 | 7 | 0 | | | outside |
| 0,25 | | 256 | | 319 | | 319 | | 256 | | inside |
| | | 124 | | 66 | | 336 | | 341 | | outside |
| 0,0 | 180 | | 300 | 331 | 0 | | 60 | | | inside |
| | 180 | | 120 | 105 | 0 | | 60 | | | outside |
| 0,25 | | | 292 | | 331 | | 292 | | | inside |
| | | | 151 | | 195 | | 277 | | | outside |
| 0,5 | | 231 | 270 | | 300 | | 270 | 231 | | inside |
| | | 188 | 180 | | 210 | | 270 | 301 | | outside |
| 0,75 | | | | | | 256 | | | | inside |
| | | | | | | 251 | | | | outside |
| 1,0 | | | | | 180 | | | | | inside |
| | | | | | 270 | | | | | outside |

47 43 51 50

INSERT BARREL WITH ADJUSTING DEVICE

BACKGROUND OF THE INVENTION

Field of the Invention

The invention relates, in general, to firearms and in particular to a new and useful insert gun barrel with adjusting device of the front insert barrel bearing.

To train the gunner and the commander of combat tanks for sighting under combat conditions, shooting from the gun on exercise grounds is an indispensible requirement. To lower the costs for diversified sighting training, there is used a socalled training equipment of a caliber which is smaller than the caliber of the barrel of the tank gun. It is crucial for the development of such an insert barrel as training equipment to obtain valid information about the accuracy of fire. For it would be psychologically wrong to train the soldier with an equipment of an accuracy of fire substantially inferior to what is possible with the original weapon. Therefore, the insert barrel must provide the possibility of equalizing the accuracy of fire for different types of ammunition, such as tank ammunition and subcaliber ammunition. If no precautions were provided for adjusting the insert barrel to a combat tank gun, a different mean point of impact would be obtained than is obtained with the normal combat tank ammunition from the combat tank barrel. The causes of this are deviations in the type of ammunition, sag or curvature of the barrels, manufacturing tolerances, and different lengths of the two barrels.

To bring the different off positions to a common mean point of impact, the insert barrel system must be trial-fired with the respective ammunition and the gun system must be given a basic setting. These operations are relatively time-consuming, and due to the repeated trial firing they result in high ammunition costs and heavy wear on the insert barrel system.

From German publication No. 12 05 759 a trial firing device for practice weapons has become known where by means of an adjusting device the front end of the insert barrel is adjustable diametrically in a straight line. The front part of the insert barrel is present between two eccentrics, which in turn are supported in openings of rotatable disks. To achieve adjustment of the insert barrel, it is necessary, after unscrewing screws, to rotate the disks, which causes them to take the eccentrics along. This rotation takes place up to a mark on a scale. By the rotation of the disks with the diametrical clamping device, the adjustability is brought into the radius of the established firing deviation of the axis of the bore of the insert barrel. With the aid of the two eccentrics the front end of the insert barrel is then displaced diametrically in a straight line, this being possible by a serration on the eccentrics. Lastly, both eccentrics are brought to abut against the barrel and the occupied position is secured by tightening screws.

Due to the many structural parts, such a device for adjustment of the insert barrel is relatively costly and complicated to adjust. Several successive operations are always necessary to obtain the desired position of the front end of the insert barrel.

SUMMARY OF THE INVENTION

The invention provides an insert barrel with an adjusting device of the front insert barrel bearing which, with relatively few parts, permits simple and quick handling of the adjusting device.

According to the invention, the front insert barrel bearing has two eccentric bushings running one in the other radially, but non-displaceably axially and which, by means of an adjusting device, are individually rotatable relative to each other radially.

As a development of this invention, the eccentric bushings may be retained on the insert barrel by a radially applied clamping bush with an expansion bush part and also by a compensating bush abutting against a collar of the insert barrel. Toward the mouth of the insert barrel, the bush parts advantageously have means for rotational entrainment by the adjusting device. The adjusting device advantageously comprises two independently rotatable tubes with means applied at their free frontal ends for rotational entrainment of the eccentric bushings of the insert barrel. They are advantageously equipped with a lever at the front end faces of each tube. The levers are radially secured on rings which are fixed to the tube ends by cylindrical pins in bores uniformly distributed over the circumferences. At the front ends of the tubes of the adjusting device there may be provided axially a fixed dial which indicates the respective adjustment angle of the two levers and evaluates it with respect to the off position from the common mean point.

With these features according to the invention, it becomes possible with simple means and within a short time to bring the hit pattern of the insert barrel into coincide with the hit pattern of the tank gun. Due to the two eccentric bushings running one in the other, which can be rotated relative to each other by the adjusting device, it is possible to cover a required adjustment diameter area at every point. The approach to each individual point on the adjustment diameter is effected solely by the rotation of the two eccentric bushings relative to each other. The adjustment angle needed in each instance is obtained by rotating the two levers up to a scale value which corresponds to the off positions of the insert barrel to the right or left or respectively up or down. By this method ammunitions differences an be eliminated at the same time.

While heretofore the adjustable clamping element could be operated only when it was located in the immediate vicinity of the mouth of the barrel of the tank vehicle, thus representing an optically visible adjustment, by the adjusting device according to the invention the hit pattern of the insert barrel can be modified also when the front barrel bearing of the insert barrel is located at some distance from the mouth of the main barrel.

While heretofore the adjustable clamping element could be operated only when it was located in the immediate vicinity of the mouth of the barrel of the tank vehicle, thus representing an optically visible adjustment, by the adjusting device according to the invention the hit pattern of the insert barrel can be modified also when at the front barrel bearing of the insert barrel is located at some distance from the mouth of the main barrel.

Accordingly, it is an object of the invention to provide an insert barrel construction for a main gun barrel which comprises an insert barrel which is supportable in the gun barrel on two axially spaced bearings. At least one of the bearings including an inner and outer eccentric bushing which are arranged for rotation relative to each other and which support the main gun barrel so that relative rotation between the bushings effects a change in the firing angle of the barrel.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

BRIEF DESCRIPTION OF THE DRAWINGS

In the drawings:

FIG. 8 is a scale for the adjusting device with table values.

GENERAL DESCRIPTION OF THE DRAWINGS

Figure 1:
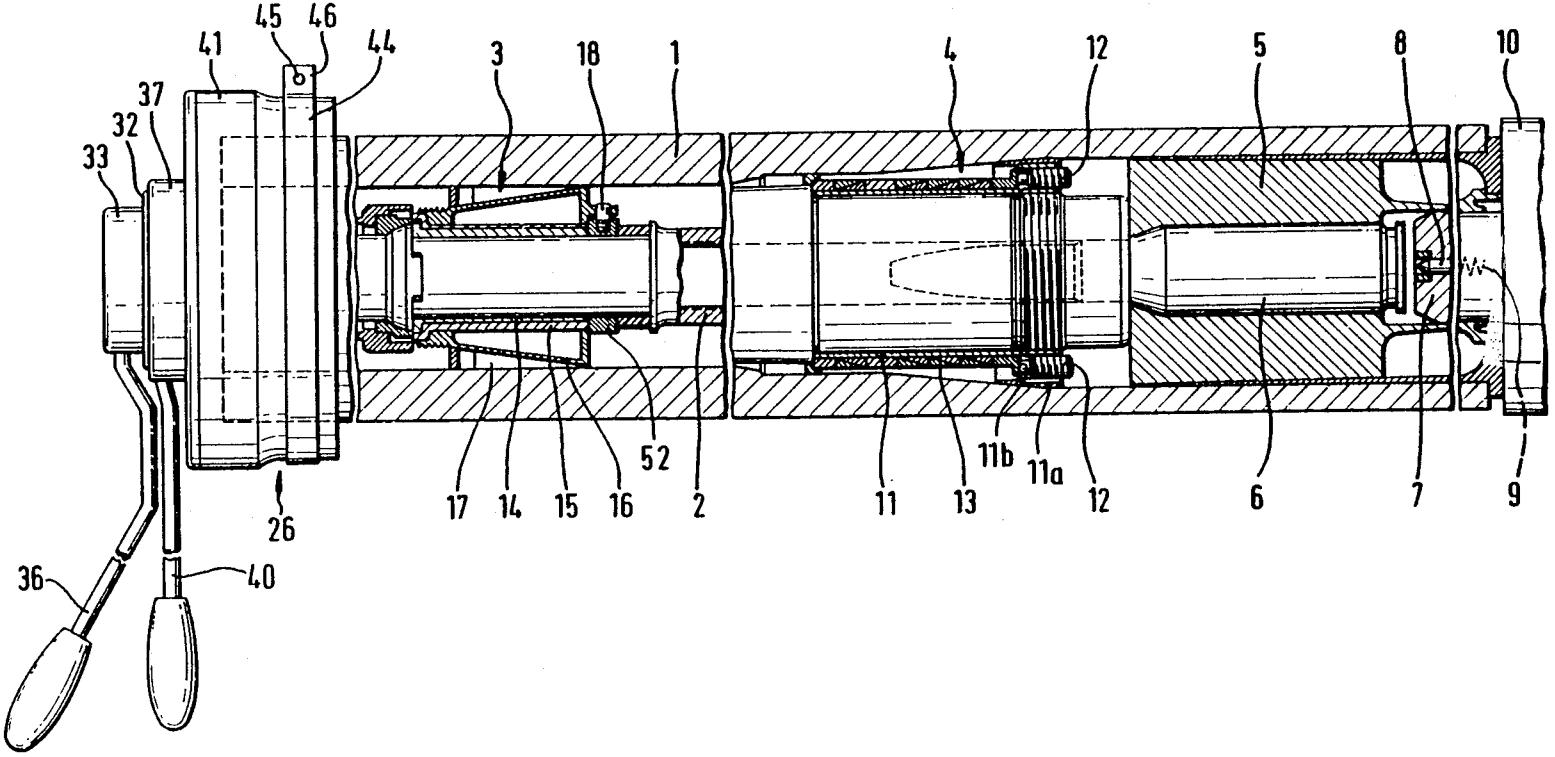
FIG. 1 is a partial side elevational and axial sectional view of an insert barrel system with an adjusting device of the front barrel bearing of the insert barrel, constructed in accordance with the invention.
Figure 3:
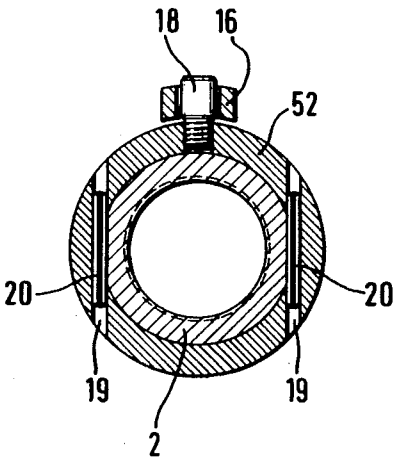
FIG. 3 is a section through the line 3–3 of the clamping device of FIG. 2 showing the front barrel bearing.

Referring to the drawings, in particular, the invention embodied therein comprises an insert barrel 2 for a main gun barrel 1 which is insertable in the main barrel and supported therein on spaced bearings including a front bearing insert 3 and a rear bearing insert 4. In accordance with the invention, the front bearing insert 3 includes an inner eccentric bearing 14 rotatable within an outer bushing 15 for the purpose of changing the axial alignment of the insert barrel 2.

Inserted in a barrel 1 of a tank vehicle is an insert barrel 2 which is mounted centrically in the barrel 1 by a front and a rear insert barrel bearing 3 and 4.

The insert barrel 2 is much shorter than the barrel 1 of the tank vehicle, and therefore the front bearing 3 is installed in barrel 1, not at the mouth of the barrel 1, but away from this mouth. The distance may well be as much as two meters for example.

The cartridge chamber 5 contains in the area of the rear insert barrel bearing 4 the cartridge 6 of smaller caliber as compared with the barrel 1. Axially following the cartridge 6 is a cylinder 7 which serves to receive a firing pin 8 with a firing pin spring 9. Rearwardly the cartridge chamber 5, together with a firing pin device 8 and 9, is closed off by the plug 10 of the breech.

The rear insert barrel bearing 4 constitutes a radial and axial position fixation and clamping of the insert barrel 2 in barrel 1 of the tank-carried gun. In the example of FIG. 1, the rear insert barrel bearing 4 is a clamping sleeve 11 having a collar 11*a* in which several clamping screws 12 are inserted. Mounted on a clamping sleeve shank portion are annular clamping elements 13 which due to their cone-shaped faces act radially outward and inward when the clamping screws 12 are tightened against an end element 11*b* of the sleeve 11. This ensures the centered position of the insert barrel 2, in its rear region, in barrel 1.

Now since normally in combat tanks also the front part of the insert barrel 2 is firmly centered, first always an optical adjustment of the main barrel is made, which constitutes the basic setting. This basic setting, however, cannot be changed reproducibly without renewed trial firing. This means that after firing from the insert barrel 2, the main barrel 1 of the combat tank must always be trial fired again with the main ammunition so that the combat tank will be ready for combat at all times. Now this method is very costly, and for this reason a front insert barrel 3 has been chosen in the invention which comprises an inner end and outer eccentric bushings 14 and 15.

Figure 2:
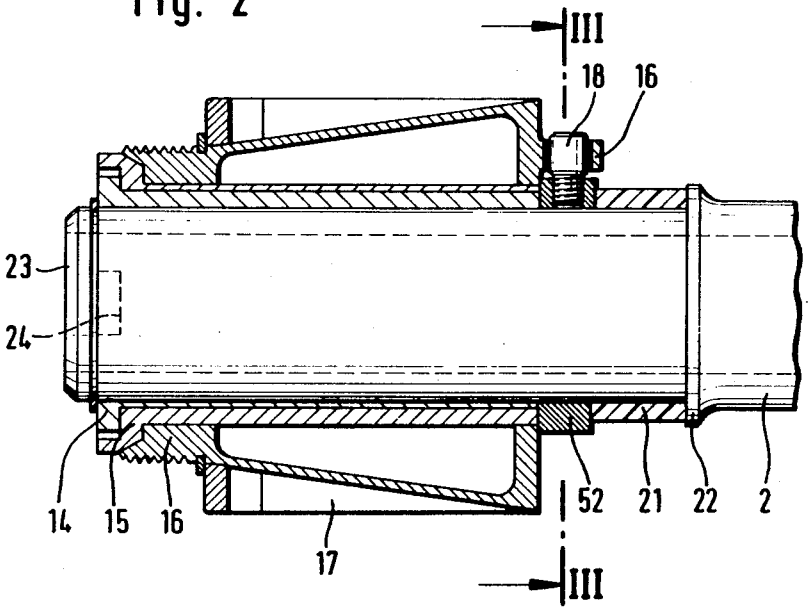
FIG. 2 is a sectional view of the front insert barrel bearing of FIG. 1 on a larger scale.

These two eccentric bushings 14 and 15 have walls which run one in the other and they are retained on the insert barrel 2 by a clamping bush 16 and an external expansion bush 17. Attachment of the clamping bush 16 occurs by engaging a clamping screw 18 into a pressure disk 52 (FIG. 2). Cut into the pressure disk 52 are tangentially extending passages 19, into which clamping pins 20 are introduced. For axial fixation of the two eccentric bushings 14 and 15, a compensating bush 21 is used which takes support on a collar 22 of the insert barrel 2 and abuts against the pressure disk 52. On the end face of the insert barrel 2 which is directed toward an insert barrel mouth 23, the eccentric bushings 14 and 15 have rotational entrainment means in the form of openings 24 into which a lug 25 of an adjusting device 26 (FIG. 4) engages for adjustment by rotation.

Figures 4, 5, 6, 7:
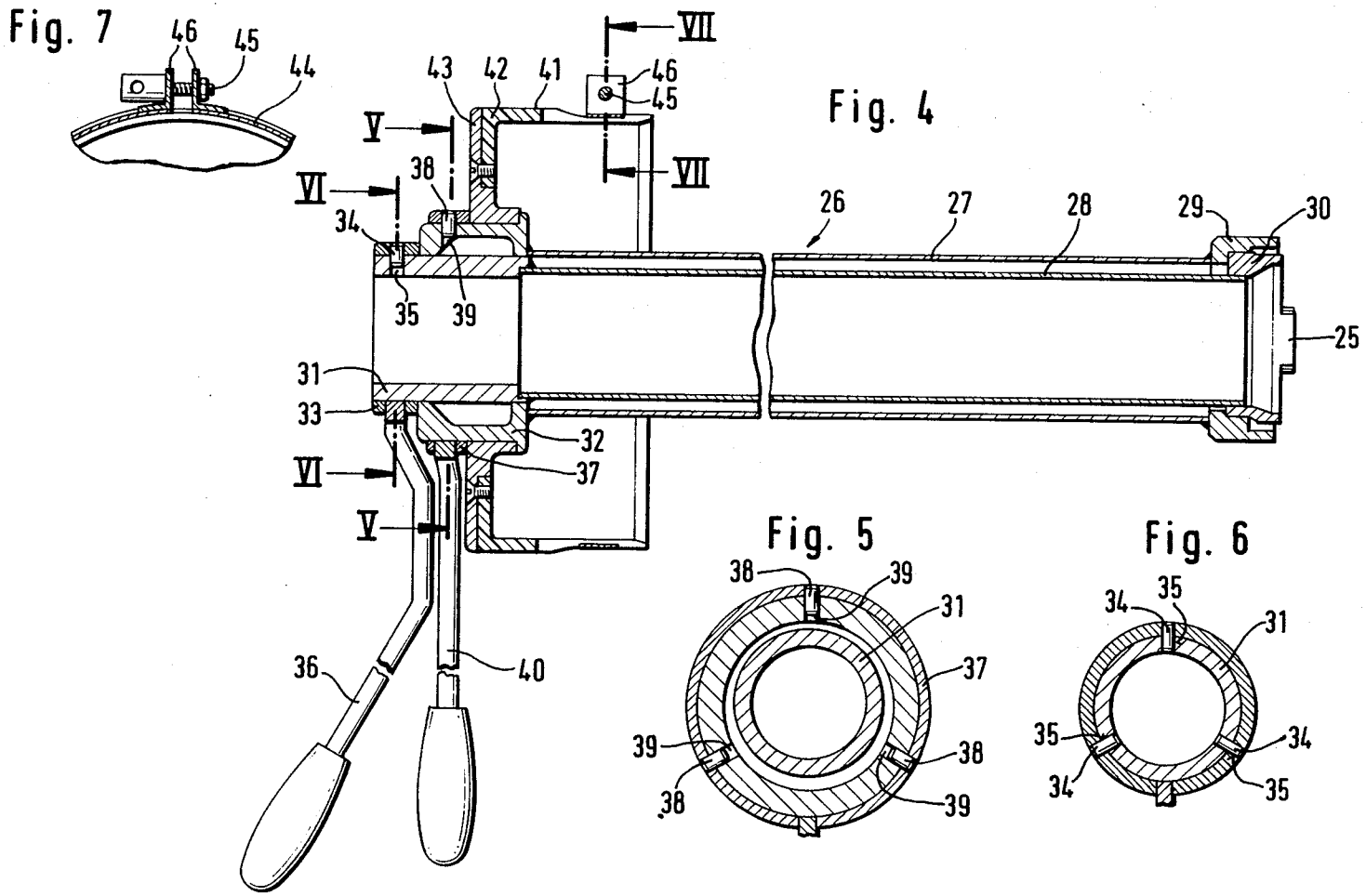
FIG. 4 is an axial sectional view of the adjusting device for the front insert barrel bearing.
FIG. 5 is a section through the adjusting device taken alone line V–V in FIG. 4.
FIG. 6 is a section through the adjusting device taken along line V–V in FIG. 4.
FIG. 7 is a partial sectional view of the clamping element of the adjusting device taken along line VII–VII in FIG. 4.

The adjusting device 26 according to FIG. 4 has two tubes 27 and 28 arranged one inside the other, which are equipped at their rear end faces with rotational entrainment means 29 and 30. At each of their front ends the two tubes 27 and 28 have an inner sleeve 31 and 32. On the inner sleeve 31 for the inner tubes 28 a ring 33 is secured in bores 35 by pins 34 uniformly distributed over the circumference. The ring or sleeve 31 has a lever 36. The outer sleeve 32 is firmly connected with the outer tube 27 and also possesses a ring 37 which again is retained by pins 38 in bores 39 uniformly distributed over the circumferences and comprises a second lever 40. By means of the two levers 36 and 40 the tubes 27 and 28 can be rotated in both directions of rotation independently of each other.

With this adjusting device it is possible, although the insert barrel 2 is arranged remote from the mouth of the barrel 1, to adjust the two eccentric bushings 14, 15 as needed independently of the position of the front cartridge chamber 3 in barrel 1.

On the generated surface of sleeve 32 is a housing 41, whose front axial leg surface 42 is provided with a scale 43 for angular adjustment of the levers 36 and 40.

The outer annular faces 44 of housing 41 is held together by a clamping screw 45 which is inserted in two opposite brackets 46.

The scale 43 on the axial end face of housing 41 is illustrated in principle in FIG. 8. While the upper row 48 indicates the off positions from the mean point of impact to the left or right, the left column 49 contains the off positions downwardly or upwardly from the mean impact point position. The right column 50 shows in blocks one below the other the inner and the outer eccentric bushings 14 and 15 of the insert barrel 2. The central circular area 47 shows by way of example values in degrees of angle for the adjustment of the levers 36 and 40 to get to a desired off position. The two levers 36 and 40 are each rotatable 360°. They serve to rotate the inner and outer tubes 27 and 28 as well as the eccentric bushings 14 and 15 in active connection with them. Now if in firing an off position from the desired position is detected, this off position can be read from the table. If this value shows in the table in FIG. 8, for example, in column 49 the value 0.5 low and in line 48 the value 0.5 right, it can be read in the field 51 inside the circular area 47 that in this example the inner eccentric bushing 14 as well as the outer eccentric bushing 15 must each be rotated by 270°.

Now the amount of rotation established with reference to these tubular values is obtained by the fact that through the levers 36 and 40 the eccentric bushings 14 and 15 can be rotated independently of each other. As these two eccentric bushings describe in principle two circles by which a large circular area is completely covered, the tube center can be adjusted to any given point in this circular area. Due to this, the mean impact point position can be changed and after a change of position, the insert barrel 2 can aim at a different direction each time.

As this adjusting device allows for the separate adjustment of barrel 2 inside the barrel of the tank gun 1, the gun barrel 1 of this combat tank needs no readjusting after the removal of the insert barrel 2 in order to fire regular tank ammunition. Therefore, the combat tank is, without changes in the basic setting, always ready for combat.

While specific embodiments of the invention have been shown and described in detail to illustrate the application of the principals of the invention, it will be understood that the invention may be embodied otherwise without departing from such principals.

What is claimed is:

1. An insert barrel construction for a main gun barrel, comprising an insert barrel, bearing means rotatably supporting said insert barrel within the main gun barrel, said bearing means including inner and outer eccentric bushings, said inner eccentric bushing arranged within said outer eccentric bushing and being arranged around said insert barrel and supported in the main gun barrel, said inner bushing being rotatable relative to said outer bushing shifting said insert barrel within the main gun barrel, means for supporting said inner and outer eccentric bushings within the main gun barrel including a radially applied clamping bush positioned to engage an interior of the main gun barrel and an expansion bush arranged over said clamping bush and bearing against said clamping bush, said insert barrel having an external shoulder forming a collar, a pressure disk engaged over said insert barrel, a compensating bushing engaged over said insert barrel between said clamping bush and said collar and pin means engageable with said pressure disk for holding said pressure disk against rotation with respect to said insert barrel.

2. An insert barrel according to claim 1, including means on said insert barrel defining a device for adjusting said eccentric bushings.

3. An insert barrel according to claim 2, including said adjusting device comprising first and second telescoped tubes being rotatable relative to each other, said tubes having inner ends engaged with respective ones of said inner and outer eccentric bushings and including exterior ends of said tubes extending outside of the main gun barrel and having adjustment levers connected to respective ones of said exterior ends of said tubes.

4. An insert barrel according to claim 3, wherein said levers are fastened to extend radially outwardly of each of said tubes and including a ring and a sleeve fastened to the exterior of each of said tubes, said rings having circumferentially spaced openings therein, a cylindrical pin extending through each of said spaced openings and engaged into a bore of an associated one of said sleeves.

5. An insert barrel according to claim 4, including indicator means associated with at least one of said tubes for indicating an angular position of said tubes and said inner and outer eccentric bushings in active connection with said tubes.

* * * * *